United States Patent [19]

Katz et al.

[11] Patent Number: 4,552,857

[45] **Date of Patent: * Nov. 12, 1985**

[54] CATHODE COATING WITH HYDROGEN-EVOLUTION CATALYST AND SEMI-CONDUCTING POLYMER

[75] Inventors: Michael Katz, Geneva; Jean Hinden, Chambesy; Jurgen Gauger, Thonex, all of Switzerland

[73] Assignee: ELTECH Systems Corporation, Boca Raton, Fla.

[ * ] Notice: The portion of the term of this patent subsequent to Jul. 10, 2001 has been disclaimed.

[21] Appl. No.: 365,185

[22] Filed: Apr. 5, 1982

[30] Foreign Application Priority Data

Apr. 9, 1981 [GB] United Kingdom ..... 8111256

[51] Int. Cl.[4] ..... H01M 4/88; B05D 5/12

[52] U.S. Cl. ..... 502/101; 427/123; 427/126.1; 427/126.3; 427/126.6; 427/226; 427/388.2; 427/86

[58] Field of Search ..... 427/125, 126.5, 123, 427/126.1, 126.3, 126.6, 86, 226, 388.2; 502/101

[56] References Cited

U.S. PATENT DOCUMENTS

| | | | |
|---|---|---|---|
| 3,438,815 | 4/1969 | Giner | 429/42 |
| 3,438,817 | 4/1969 | Short et al. | 429/42 |
| 3,632,498 | 1/1972 | Beer | 204/290 F |
| 3,798,063 | 3/1974 | Decraene | 428/328 |
| 3,881,957 | 9/1975 | Hausler | 429/30 |
| 4,043,933 | 8/1977 | Breault et al. | 429/42 X |
| 4,118,294 | 10/1978 | Pellegri | 204/129 |
| 4,285,796 | 8/1981 | Stoner et al. | 204/290 R |
| 4,439,313 | 3/1984 | Katz | 204/290 R |
| 4,459,324 | 7/1984 | Gauger | 204/290 R |

*Primary Examiner*—John F. Niebling

*Attorney, Agent, or Firm*—Arthur S. Collins

[57] ABSTRACT

A cathode coating comprises a catalyst for hydrogen evolution finely dispersed in a matrix consisting of an insoluble, semiconducting polymer which is formed in situ on an electrode support body. A bipolar electrode is provided with such a cathode coating on a support body consisting of a valve metal such as titanium.

The cathode coating is formed by applying to the electrode support body a coating solution which contains an inorganic precursor compound for the hydrogen evolution catalyst and an organic precursor compound for forming the polymer matrix, drying and then thermally converting these precursors to a cathode coating adhering to the electrode support body.

11 Claims, No Drawings

CATHODE COATING WITH HYDROGEN-EVOLUTION CATALYST AND SEMI-CONDUCTING POLYMER

FIELD OF THE INVENTION

The invention relates to electrolytic cells, and more particularly to hydrogen-evolution cathodes and bipolar electrodes for the electrolysis of aqueous electrolytes.

BACKGROUND OF THE INVENTION

Various cathodes have been studied for use in electrochemical reactions involving hydrogen-evolution. Since the technical breakthrough of corrosion-resistant valve metal electrodes, especially dimensionally stable anodes, many efforts have been made to obtain a valve metal supported bipolar electrode which could be activated over one surface with an anodically stable, electrocatalytic coating generally comprising a platinum group metal or platinum group metal oxide, and which could perform satisfactorily as a hydrogen evolution cathode over its other surface.

When hydrogen ions are cathodically discharged, hydrogen atoms are adsorbed on the surface and diffuse into the crystal lattice of the metal cathode, giving rise to the formation of hydrides which may precipitate at the grain boundaries within the metal structure.

Valve metal electrodes are badly affected by adsorbed hydrogen atoms which migrate into the valve metal and form hydrides, causing expansion of the valve metal lattice, weekening of its structure and peeling off of the electrocatalytic coating.

Proposals to solve this problem are described in U.S. Pat. No. 4,000,048, whereby the valve metal is coated with a layer of palladium-silver or palladium-lead alloy having a hydrogen desorption/adsorption ratio lower than unity. However, this involves the use of expensive noble metal cathodic coatings.

Recently, bipolar electrode assemblies with reportedly low hydrogen permeability rates have been proposed. U.S. Pat. No. 3,920,535 describes a multilayer composite comprising a valve metal plate coated with a suitable anodic material over one surface and with a silicon layer over the opposite surface, the silicon being protected by a metal coating suitable for the cathodic conditions. This silicon layer is intended to reduce hydrogen diffusion through the composite assembly, but it has a low electrical conductivity.

Another publication of interest is U.S. Pat. No. 3,884,792 relating also to multilayer metal electrodes having an intermediate layer of a metal substantially resistant to hydrogen diffusion. Generally speaking, the fabrication of known composite bipolar electrodes is complex and needs accurate control of the various coating processes to avoid damaging the adherence of previously applied layers.

U.S. Pat. No. 4,118,294 relates to a cathode composed of conductive powder embedded in a cured thermosetting resin, the cathodically operative surface being enriched with a hydrogen-evolution catalyst.

The various hydrogen-evolution cathodes and bipolar electrodes proposed hitherto nevertheless generally present several technical and economic limitations such as: high cost, complicated manufacture, unsatisfactory long-term electrocatalytic performance.

SUMMARY OF THE INVENTION

One object of the invention is to provide a hydrogen-evolution cathode whereby the limitations previously mentioned with respect to the prior art may be eliminated as far as possible.

Another object of the invention is to provide a bipolar valve metal electrode with an electrocatalytic coating comprising a hydrogen-evolution catalyst on the cathodically operative electrode surface.

A further object of the invention is to provide such an electrocatalytic cathode coating capable of protecting the underlying valve metal from deterioration due to hydrogen.

The present invention provides an electrocatalytic cathode coating comprising a hydrogen-evolution catalyst finely dispersed in a semi-conducting, insoluble polymer matrix formed in situ on an electrically conductive substrate, and a process for its manufacture, as set forth in the claims.

The conductive substrate on which the cathode coating is formed in accordance with the invention may consist of any suitable electrochemical valve metal such as titanium or a valve metal alloy, especially in the case of a bipolar electrode with on one hand an anodically operative surface with any suitable catalytic coating, and on the other hand, a cathodically operative coating comprising a hydrogen evolution catalyst in accordance with the invention.

The conductive substrate for the cathode coating according to the invention may moreover consist of other metals or alloys, such as steel, stainless steel, nickel, aluminium, lead, or their alloys. The cathode coating may moreover be possibly formed on a graphite substrate. Such other substrates may be more particularly used for cathodes alone, while valve metal substrates may be advantageously used for bipolar electrodes.

Poly-p-phenylene (PPP) was successfully used to produce a coating according to the invention, as is described further below. Some other polymers which may be suitable are: polyacrylonitrile (PAN), polyacrylamide or other derivatives of polyacrylic acid. Soluble aromatic polymers may also be used in the invention, such as for example: aromatic polyamides, aromatic polyesters, polysulfones, aromatic polysulphides, epoxy, phenoxy, or alkyde resins containing aromatic building blocks, polyphenylenes or polyphenylene oxides, poly-acenaphthylene.

Heteroaromatic polymers may further be suitable for the invention, such as for example polyvinyl pyridine, polyvinylpyrrolidone, or polytetrahydrofurane.

Prepolymers which are convertible to heteroaromatic polymers, for example to polybenzoxazoles or polybenzimidazopyrrolones, may likewise be suitable for the invention.

Polymers containing adamantane may likewise be suitable (especially the above prepolymers, containing adamantane units).

The liquid mixture applied to the substrate according to the invention is preferably a homogeneous solution, so as to obtain a homogeneous mixture of the coating precursor materials dissolved in the form of molecules or ions. Colloidal solutions may nevertheless be applied instead of homogeneous solutions if necessary, e.g., in case the solvents used to respectively dissolve the organic and inorganic coating precursors may be non-miscible.

The solvents used in said liquid mixture will generally be any suitable conventional solvents such as e.g. dimethyl formamide (DMF) to dissolve polyacrylonitrile (PAN) or isopropyl alcohol (IPA) to dissolve $PtCl_4$ or other platinum group metal salts.

Semiconducting insoluble polymers may be formed in coatings according to the invention by starting from various soluble polymers which can be thermally activated so as to undergo a structural change by extensive cross-linking and cyclization whereby to form aromatic or heteroaromatic rings, so as to thus be able to form a substantially continous planar semi-conducting polymer structure.

Noble metal catalysts which may be used in the coating are Pt, Pd, Ru, Rh, Ir or oxides thereof. Inexpensive base metal catalysts may likewise be used in the same manner, such as for example Co, Ni or Mo, oxides or sulphides of nickel or cobalt, molybdates or tungstates, tungsten carbide.

It may be noted that other materials may be uniformly incorporated in the coating according to the invention in generally the same manner as the hydrogen evolution catalysts. Such materials may serve to provide given properties, e.g. to further improve conductivity and/or catalytic activity of the coating, to inhibit undesirable side-reactions or to improve physical or chemical stability of the coating.

The liquid mixture applied to the substrate according to the invention may moreover contain various additives to enhance the formation of a satisfactory semiconducting polymer matrix e.g. cross-linking agents.

A coating may be produced according to the invention by applying any suitable number of layers of solution which is necessary to provide the desired thickness and surface loading with catalyst, while ensuring satisfactory adherence of the coating.

Each dried layer of solution provides a uniform coprecipitated intimate mixture of a very finely divided catalyst precursor and the organic polymer matrix precursor.

The heat treatment of this coprecipitate is then advantageously effected in air in at least two stages at different temperatures, preferably with a reduced temperature stage in the range up to about 300° C., before applying the next layer of solution and, after applying the last layer, a second stage at higher temperature at about 400° C., but at most up to 600° C.

The temperature, duration and ambient atmosphere of heat treatment should be controlled so as to be able to ensure extensive cross-linking and cyclization of the organic polymer precursor by thermal activation, so as to convert it into a substantially continuous semiconducting, insoluble, polymer network structure, while substantially preventing thermal decomposition of the organic polymer structure or carbonization of the organic polymer.

These conditions of heat treatment must at the same time be selected so as to also allow conversion of the coprecipitated catalyst precursor compound into a finely divided catalyst, uniformly dispersed and completely integrated in said semiconducting polymer network structure forming a substantially continuous matrix.

One heat treatment stage in air may be carried out for example in a restricted temperature range between 250° C. and 300° C., while a subsequent stage may be carried out in air in a higher range between 300° C. and 400° C., or even higher, e.g. 500° C. or even up to 600° C. in some instances.

The duration of heat treatment in air may vary from 5 minutes to about 2 hours according to the nature of the organic polymer.

Moreover, the reduced temperature heat treatment stage in air may if necessary be followed by a heat treatment stage in a non-oxidative or inert atmosphere such as argon or nitrogen, possibly at higher temperatures up to 800° C., for a duration for example between 15 minutes and 6 hours.

It was experimentally established that the coatings thus produced became semiconductive after undergoing heat treatment.

The following examples serve to illustrate the production and use of electrocatalytic coatings for hydrogen evolution, in accordance with the invention.

EXAMPLE I

An activating solution (P61) of poly-p-phenylene (PPP) and Pt was prepared by dissolving 100 mg PPP and 50 mg $PtCl_4$ in 4 ml dimethylformamide (DMF) and 25 μl HCl. A homogeneous solution was obtained after stirring the mixture at room temperature for 24 h. The concentration of PPP and Pt in the resulting solution was 25.2 and 7.2 mg/g solution respectively.

A titanium sheet, which was sandblasted and etched in oxalic acid for 8 h, was coated with the above mentioned solution. Nine layers were applied. After drying each layer at 100° C. for 5 minutes, a heat treatment was carried out at 250° C. for 7 minutes. After heat treating the last layer at 250° C., an additional heat treatment was carried out up to 650° C. with a heating rate of 200° C./hour under an argon atmosphere. The coated sheet was kept at 650° C. for 1.5 h.

The loading of PPP and Pt corresponded to 2.8 g PPP/$m^2$ and 0.8 g Pt/$m^2$ respectively.

The resulting electrode is being tested as a hydrogen evolving cathode at 4500 A/$m^2$ in 135 gpl NaOH at 90° C. It has accumulated 3800 h under these conditions without changing its initial potential of −1.35 V vs. Hg/HgO. No hydride formation could be traced.

EXAMPLE II

A solution (P61) was prepared as in Example I.

The coating substrate in this case was a titanium mesh which as pretreated was described in Example 1.

Ten layers of the solution (P61) were applied to the pretreated titanium mesh, each layer applied being dried at 100° C. for 5 minutes and then thermally treated in air at 250° C. for 10 minutes. After heat treating the last layer in this manner, an additional heat treatment was carried out at 400° C. in air for 15 minutes. This was followed by a final heat treatment carried out at 500° C. in air for 20 minutes.

The loadings of poly-p-phenylene (PPP) and platinum per unit area of the titanium mesh corresponded respectively to 2.8 g PPP/$m^2$ and 0.8 g Pt/$m^2$.

The resulting electrode sample was submitted to testing as a hydrogen evolving cathode operating at 3100 A/$m^2$ in a chlorate cell containing 100 g/l NaCl, 300 g/l $NaClO_3$ and 2 g/l $Na_2Cr_2O_7$ at a pH of 6.7–7.0 and a temperature of 60° C. It has accumulated 600 hours of operation under these conditions and is operating at a potential of 1.27 V vs. SCE (Saturated Calomel Electrode). This corresponds to a voltage saving of 0.32 V with respect to pure titanium.

EXAMPLE III

A solution was prepared by dissolving 100 mg of an adamantane-base polybenzoxazole (PBO) prepolymer and 50 mg of $PtCl_4$ in 4 ml dimethylformamide (DMF) and 25 μl HCl. A homogeneous solution was obtained after stirring the mixture for 24 hours at room temperature.

The concentration of PBO and platinum, per gram of this solution, corresponded respectively to 25.2 mg PBO/g and 7.2 mg Pt/g.

The coating substrate was in this case a titanium sheet (10×2 cm) which was pretreated by sand-blasting and etching in boiling 15% HCl solution 1 hour.

Eight layers of the solution were successively applied to the pretreated titanium sheet. Each layer was dried at 100° C. for 15 minutes and the heat treated at 250° C. for 10 minutes in an air flow of 60 l/h.

After heat treatment of the last layer applied at 250° C., an additional heat treatment was carried out in an argon atmosphere: The temperature was raised progressively at a heating rate of 200° C./h up to 800° C., kept at that value for 1 hour and then lowered down to room temperature within 8 hours.

The loading of PBO and platinum, per unit area of the titanium sheet, corresponded respectively to 2.8 g PBO/$m^2$ and 0.8 g Pt/$m^2$.

The resulting coated electrode sample was tested as a hydrogen-evolving cathode in a solution comprising 100 g/l NaCl, 300 g/l $NaClO_3$ and 2 g/l $Na_2CrO_7$ and exhibited an initial potential of 1.37 V vs SCE (Saturated Calomel Electrode).

The invention allows substantial advantages to be achieved by means of a very simple combination of steps which can be carried out reproducibly at low cost and only require relatively simple equipment for the preparation, application and drying of exactly predetermined liquid compositions, and for controlled heat treatment.

Thus, for example, the invention may provide the following advantages:

(i) A semiconducting, insoluble, stable polymer matrix is formed directly in situ on the substrate surface, by controlled application of a predetermined liquid composition, followed by controlled heat treatment.

(ii) The catalyst simultaneously formed in situ is uniformly distributed throughout the semi-conducting polymer matrix so as to provide a consolidated coating of uniform composition.

(iii) This uniform distribution thus allows the catalyst to be used as effectively as possible, i.e. a minimum amount of platinum group metal catalyst need to be incorporated in the coating, only in order to provide adequate catalytic properties.

(iv) On the other hand, the semi-conducting polymer matrix itself provides adequate current conduction and uniform current distribution throughout the coating, thereby allowing it to support high current densities.

(v) The semiconducting insoluble polymer matrix is moreover relatively stable and resistant to both physical and electrochemical attack, and thus may serve as a semiconducting protective binder for the catalyst, while at the same time effectively protecting the underlying substrate from hydriding and promoting adherence of the coating to the substrate.

(vi) The above advantages may more particularly provide inexpensive corrosion resistant dimensionally stable electrodes with low overpotential for hydrogen evolution, stable electrochemical performance and a long useful life under severe operating conditions.

(vii) Electrode bases of any desired size and more or less complicated shape may moreover be easily coated, and recoated when necessary, in accordance with the invention.

The cathode and the bipolar electrodes of the invention according to the claims are useful in electrolytic reactions in aqueous media. They are particularly useful for hydrogen evolution in the electrolysis of: sea water or dilute brines for the production of hypohalites; brines for the production of halites or for the production of halogen and caustic; and water in both acid and alkaline media for the production of hydrogen and oxygen.

We claim:

1. A method of manufacturing a cathode comprising a catalytic coating for electrolytically evolving hydrogen formed on an electrically conductive electrode support, characterized by the steps of:

(a) preparing a homogeneous coating solution containing on one hand a dissolved organic polymer precursor selected from the group consisting of: poly-p-phenylene, polyacrylonitrile, a prepolymer of polybenzimidazo-pyrrolone, and a prepolymer of an adamantane-based polybenzoxazole, and further containing on the other hand a dissolved inorganic precursor compound which can be thermally converted into a catalyst for evolving hydrogen;

(b) applying said homogeneous coating solution in successive layers to said conductive electrode support;

(c) drying each of said layers of the solution applied in step (b), thereby providing a coprecipitated intimate mixture of said catalyst precursor compound and said organic polymer precursor; and (d) subjecting each dried layer obtained in step (c) to heat treatment comprising at least one stage carried out in air at a temperature in the range from 200° C. to about 600° C., during 5 to 120 minutes, so as to thermally convert said organic polymer precursor to a semi-conducting insoluble polymer and said inorganic precursor compound to said catalyst for evolving hydrogen;

thereby providing the cathode with a consolidated adherent catalytic coating in which said catalyst is finely dispersed and uniformly distributed throughout a matrix consisting of said semi-conducting insoluble polymer formed therewith in situ on said conductive electrode support.

2. The method of claim 1 wherein said electrode support consists of metal.

3. The method of claim 2, wherein the metal is electrochemical valve metal.

4. The method of claim 3 wherein said valve metal is titanium.

5. The method of claim 1, wherein heat treatment is carried out in at least two stages at different temperatures.

6. The method of claim 5, wherein a first heat treatment is carried out in air in a temperature range from about 250° C. to about 400° C. after applying and drying each layer of solution, and a further heat treatment is carried out in a non-oxidizing atmosphere in a temperature range from about 400° C. to about 900° C. after applying the last layer.

7. The method of claim 6, wherein the duration of said further heat treatment is between 15 minutes and 6 hours.

8. The electrolytic, hydrogen-evolving catalytically coated cathode product manufactured by the method of claim 1.

9. A method of manufacturing a cathode for evolving hydrogen electrolytically and which comprises an electrically conductive substrate having an adherent electrocatalytic coating characterized by the steps of:

(a) preparing a homogeneous coating solution comprising on the one hand a dissolved organic polymer precursor which can be thermally converted into a semi-conducting, insoluble polymer, and comprising on the other hand a dissolved inorganic precursor compound which can be thermally converted into an active catalyst for hydrogen evolution, and (b) applying said homogeneous coating solution to an electrically conductive valve metal substrate in successive layers each of which is individually dried and heat treated at temperatures in the range of about 200° C. to about 600° C. until said organic polymer precursor and said inorganic precursor compound have been converted to a semi-conducting polymer and said active hydrogen-evolving catalyst respectively;

thereby providing on said valve metal substrate a consolidated adherent catalytic coating the active catalyst in which is finely dispersed and uniformly distributed throughout a matrix of said semi-conducting, insoluble polymer coformed in situ therewith.

10. The method of claim 9, characterized in that said substrate consists of an electrochemical valve metal.

11. The method of claim 10, characterized in that said valve metal is titanium.

* * * * *